US006799908B1

(12) United States Patent
Park et al.

(10) Patent No.: US 6,799,908 B1
(45) Date of Patent: Oct. 5, 2004

(54) DEVELOPER UNIT HAVING METERING ROLLER FOR WET-TYPE COLOR IMAGE FORMING APPARATUS

(75) Inventors: Woo-yong Park, Suwon-si (KR); Jong-woo Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/359,540

(22) Filed: Feb. 7, 2003

(30) Foreign Application Priority Data

Feb. 7, 2002 (KR) ..... 2002-7026

(51) Int. Cl.[7] ..... G03D 5/06; G03G 15/10

(52) U.S. Cl. ..... 396/604; 396/606; 399/237; 399/239

(58) Field of Search ..... 396/602, 604, 396/606; 399/237, 239

(56) References Cited

U.S. PATENT DOCUMENTS 5,943,534 A * 8/1999 Watanabe ..... 399/237
6,055,402 A * 4/2000 Angst et al. ..... 399/279
RE37,859 E * 9/2002 Lior et al. ..... 399/240

FOREIGN PATENT DOCUMENTS

JP 11-194622 7/1999
JP 2001-154493 6/2001

* cited by examiner

*Primary Examiner*—D. Rutledge
(74) *Attorney, Agent, or Firm*—Staas & Halsey LLP

(57) ABSTRACT

A developer unit for a wet-type color image forming apparatus. The developer unit includes a developer bath filled with a liquid developing agent to a predetermined depth, and a developing roller that develops an electrostatic latent image formed on a photoreceptor to correspond to an original image by supplying the liquid developing agent while being partially immersed in the liquid developing agent. The developer unit further includes a cleaning roller that cleans the surface of the developing roller, a depositing roller that deposits the liquid developing agent onto the cleaned surface of the developing roller, and a metering roller that adjusts the thickness and concentration of the liquid developing agent deposited onto the surface of the developing roller by the depositing roller to suitable levels to develop the electrostatic latent image. The developer unit also includes a developer cartridge that supplies the liquid developing agent into the developer bath.

11 Claims, 4 Drawing Sheets

DEVELOPER UNIT HAVING METERING ROLLER FOR WET-TYPE COLOR IMAGE FORMING APPARATUS

CROSS-REFERENCE TO RELATED APPLICATIONS

This application claims the benefit of Korean Application No. 2002-7026, filed Feb. 7, 2002, in the Korean Intellectual Property Office, the disclosure of which is incorporated herein by reference.

BACKGROUND OF THE INVENTION

1. Field of the Invention

The present invention relates to an image forming apparatus, and more particularly, to a developer unit for a wet-type color image forming apparatus, having a metering roller and using a high-concentration liquid developing agent.

2. Description of the Related Art

An image forming apparatus, such as a printer, photocopier, or scanner, includes an electrostatic latent image formation unit, a developer unit to develop the electrostatic latent image, and a transfer unit to transfer the developed image to a printing paper.

A conventional wet-type color image forming apparatus having the above structure is shown in FIG. 1. In FIG. 1, reference numerals 100, 102, 104, and 106 denote first through fourth photoreceptors in which electrostatic latent images to be developed into color images of cyan (C), magenta (M), yellow (Y), and black (K) are formed, respectively. Reference numerals 110, 112, 114, and 116 denote first through fourth cleaning blades that respectively clean the first through fourth photoreceptors 100, 102, 104, and 106. Reference numeral 130 denotes a transfer belt to which the developed images are sequentially transferred from the first through fourth photoreceptors 100, 102, 104, and 106, thereby forming an overlapped color image to be transferred to a paper 90. A plurality of rollers 132, 134, 138, 140, 142, and 144, which have different functions, are arranged inside the transfer belt 130 and support the transfer belt 130 in a predetermined tensioned state. In particular, reference numeral 132 denotes a driver roller that rotates the transfer belt 130, reference numeral 134 denotes a backup roller that supports the transfer belt 130 against a transfer-to-paper roller 136 while the developed color image is transferred to a printing paper 90 and to which a voltage required for color image transfer is applied. Reference numerals 138, 140, 142, and 144 denote first through fourth transfer rollers that contact the respective first through fourth photoreceptors 100, 102, 104, and 106, with the transfer belt 130 therebetween. The transfer rollers 138, 140, 142 and 144 transfer the developed images from the respective first through fourth photoreceptors 100, 102, 104, and 106 to the transfer belt 130. Since the developed images on the first through fourth photoreceptors 100, 102, 104, and 106 are charged, the first through fourth transfer rollers 138, 140, 142, and 144 may be charged to have a polarity opposite to a polarity of the first through fourth photoreceptors 100, 102, 104, and 106, respectively.

Although not illustrated in FIG. 1, the first through fourth transfer rollers 138, 140, 142, and 144 are connected to separate power sources. Once a color image is transferred to the transfer belt 130, subsequently the color image is transferred to the printing paper 90. A voltage having a polarity opposite to the polarity of the voltage that is applied to the first through fourth transfer rollers 138, 140, 142, and 144 must be applied to the backup roller 134. Although not illustrated in FIG. 1, the backup roller 134 is also connected to a power source.

Reference numerals 120, 122, 124, and 126 denote first through fourth developers, respectively, which constitute a single developer unit to develop the electrostatic latent images. The first through fourth developers 120, 122 124, and 126 supply ink of cyan, magenta, yellow, and black to the first through fourth photoreceptors 100, 102, 104, and 106, respectively, in order to develop the electrostatic latent images on the respective first through fourth photoreceptors 100, 102, 104, and 106. The first through fourth developers 120, 122, 124, and 126 have the same internal structure. The ink of different colors is supplied to the first through fourth developers 120, 122, 124, and 126 by respective first through fourth developing rollers 120*a*, 122*a*, 124*a*, and 126*a*, which are attached to the respective first through fourth developers 120, 122, 124, and 126.

Referring to FIG. 2, the first developer 120 includes a developer bath 120*c* filled with ink 120*b* to a predetermined height, the first developing roller 120*a*, which is partially immersed in the ink 120*b* and contacts the first photoreceptor 100, and a cleaning roller 120*d*, which is immersed in the ink 120*b* and removes the unnecessary residual ink from the surface of the first developing roller 120*a*. The first developer 120 further includes an ink depositing roller 120*e*, which is immersed in the ink 120*b* and electrically deposits the ink 120*b* onto the surface of the first developing roller 120*a* from which the unnecessary residual ink has been removed, and a metering blade 120*f*, which is separated by a predetermined distance above the ink 120*b* and appropriately controls the thickness and concentration of the ink layer deposited on the first developing roller 120*a* by the ink depositing roller 120*e*. The ink depositing roller 120*e* is connected to a power source S to be able to electrically deposit the ink 120*b* on the first developing roller 120*a*. As a predetermined voltage is applied to the ink depositing roller 120*e* from the power source S, the ink 120*b* is electrically charged to be deposited onto the first developing roller 120*a*.

As described above, since the developer unit of the conventional wet-type color image forming apparatus includes the metering blade installed around the developing roller, a high-concentration ink of about 3–18% or a constant amount of ink can be supplied to the transfer roller regardless of changes in the concentration of the ink. This is done so that images can be uniformly developed.

However, when toner particles are back-plated onto the surface of the developing roller, uniform development cannot be achieved. In other words, when toner particles are stuck in the space between the metering blade and the developing roller, when toner particles that have lost magneticity form clusters, when impurities are generated, or when the metering blade has a defect at its edge, the ink may be applied partially to the developing roller or in a low concentration. The non-uniform ink layer on the developing roller is transferred to the photoreceptor. As a result, a uniform, perfect color image, as shown in FIG. 3, cannot be achieved. Instead, the final color image may have a stripe pattern P, as shown in FIG. 4.

SUMMARY OF THE INVENTION

Accordingly, it is an aspect of the present invention to provide a developer unit for a wet-type color image forming apparatus, capable of preventing image quality degradation due to toner impurities adhered to a developing roller or due to a defect in a metering roller.

Additional aspects and advantages of the invention will be set forth in part in the description which follows and, in part, will be obvious from the description, or may be learned by practice of the invention.

The foregoing and/or other aspects of the present invention may be achieved by providing a developer unit for a wet-type color image forming apparatus to develop an electrostatic latent image formed on a photoreceptor, including a developer bath filled with a liquid developing agent; a developing roller to develop the electrostatic latent image to correspond to an original image by supplying the liquid developing agent while being partially immersed in the liquid developing agent; a cleaning roller to clean a surface of the developing roller; a depositing roller to deposit the liquid developing agent onto the cleaned surface of the developing roller; a metering roller to adjust a thickness and a concentration of the liquid developing agent deposited onto the surface of the developing roller to suitable levels; and a developer cartridge to supply the liquid developing agent into the developer bath.

An initial concentration of the liquid developing agent may be 2% or more, and more specifically, may be in the range of 2–40%. In the developer unit, the metering roller may be driven by the developing roller or a separate driving source. A power source may be connected to the metering roller.

When the developer unit for the wet color image forming apparatus according to the embodiment of the present invention is used, the metering roller continuously rotates rather than being fixed, and attracts back-plated toner particles or impurities so that no toner particles or impurities are stuck to the space between the developing roller and the metering roller. As a result, a developing agent layer deposited on the developing roller can be protected from being scratched by the back-plated toner particles or impurities, and thus no unwanted stripe pattern appears on the final image.

The foregoing and/or other aspects are achieved by providing an apparatus, including a photoreceptor having an electrostatic latent image thereon; a developing roller to develop the electrostatic latent image with a developer comprised of particles; and a metering roller to continuously rotate to adjust a thickness of the developer on the developing roller. The developing roller may be partially immersed in the developer.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
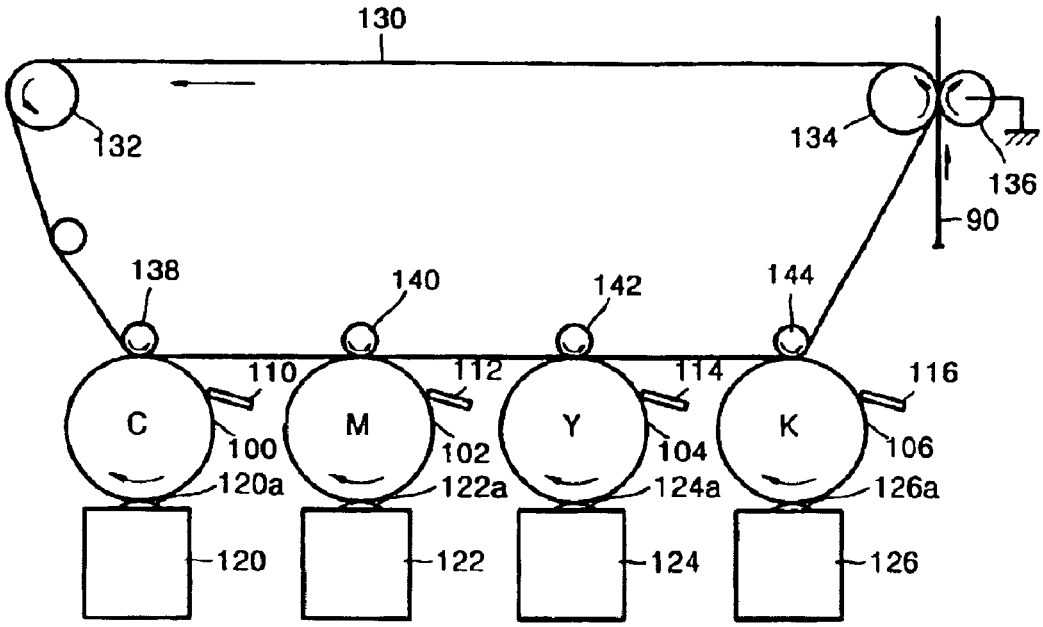
FIG. 1 (PRIOR ART)
FIG. 1 is a sectional view showing the structure of a conventional wet color image forming apparatus.
Figure 2:
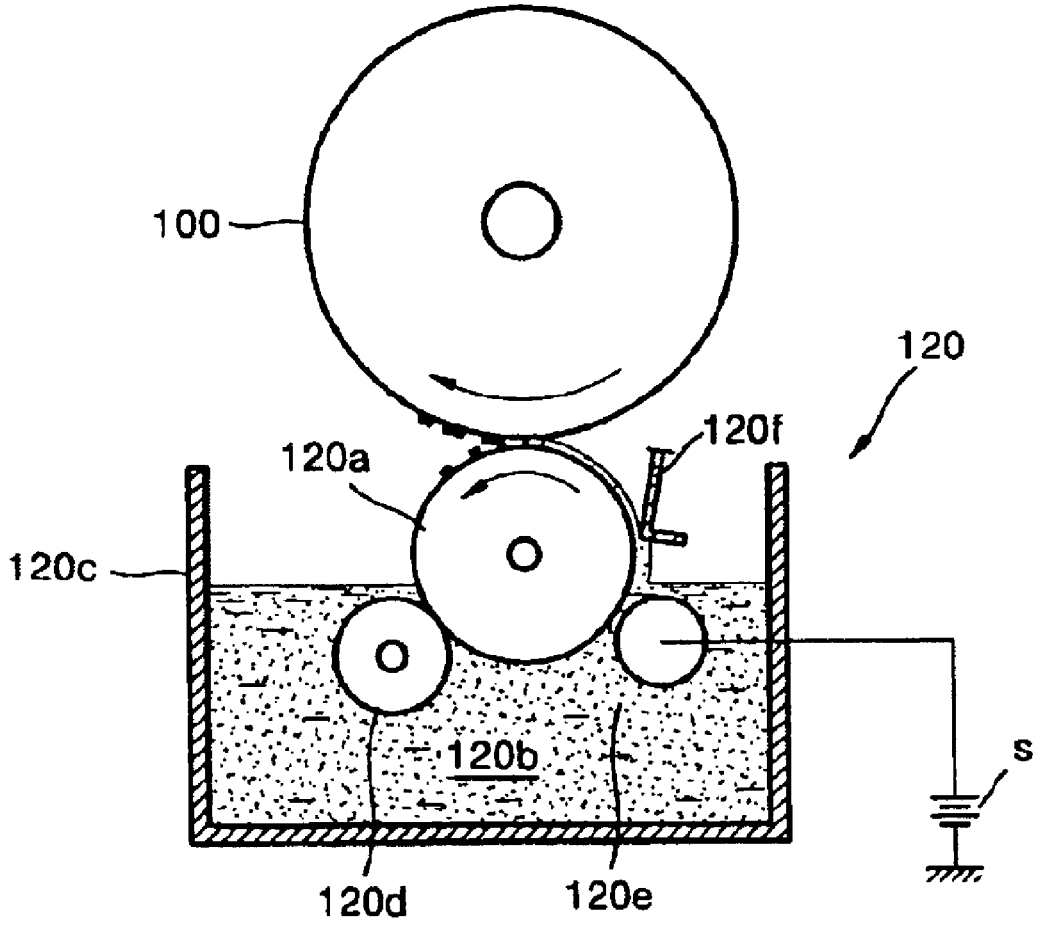
FIG. 2 (PRIOR ART)
FIG. 2 is a sectional view partially showing the internal structure of the developer unit of FIG. 1.
Figure 3:
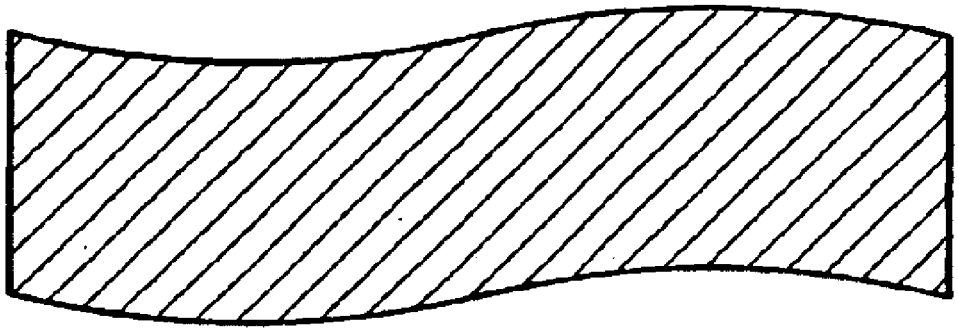
FIG. 3 shows a uniform full solid image.
Figure 4:
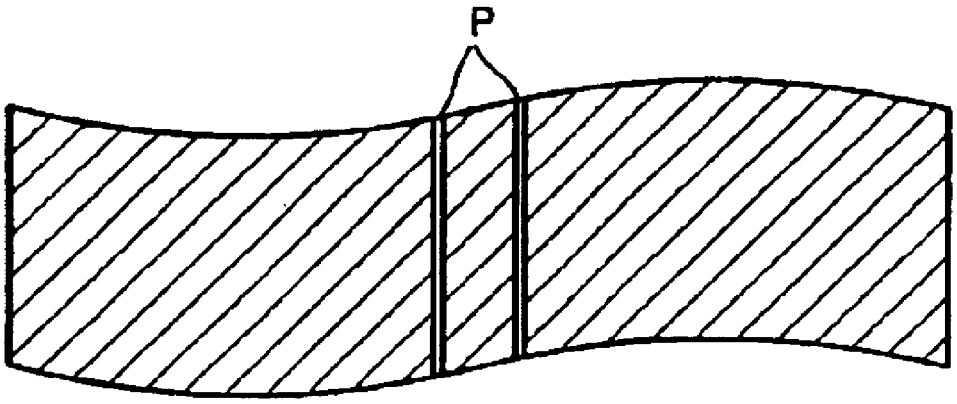
FIG. 4 (PRIOR ART)
FIG. 4 shows a non-uniform full solid image having a stripe pattern, according to the conventional apparatus.

Reference will now be made in detail to the present preferred embodiment of the present invention, an example of which is illustrated in the accompanying drawings, wherein like reference numerals refer to like elements throughout.

Figure 5:
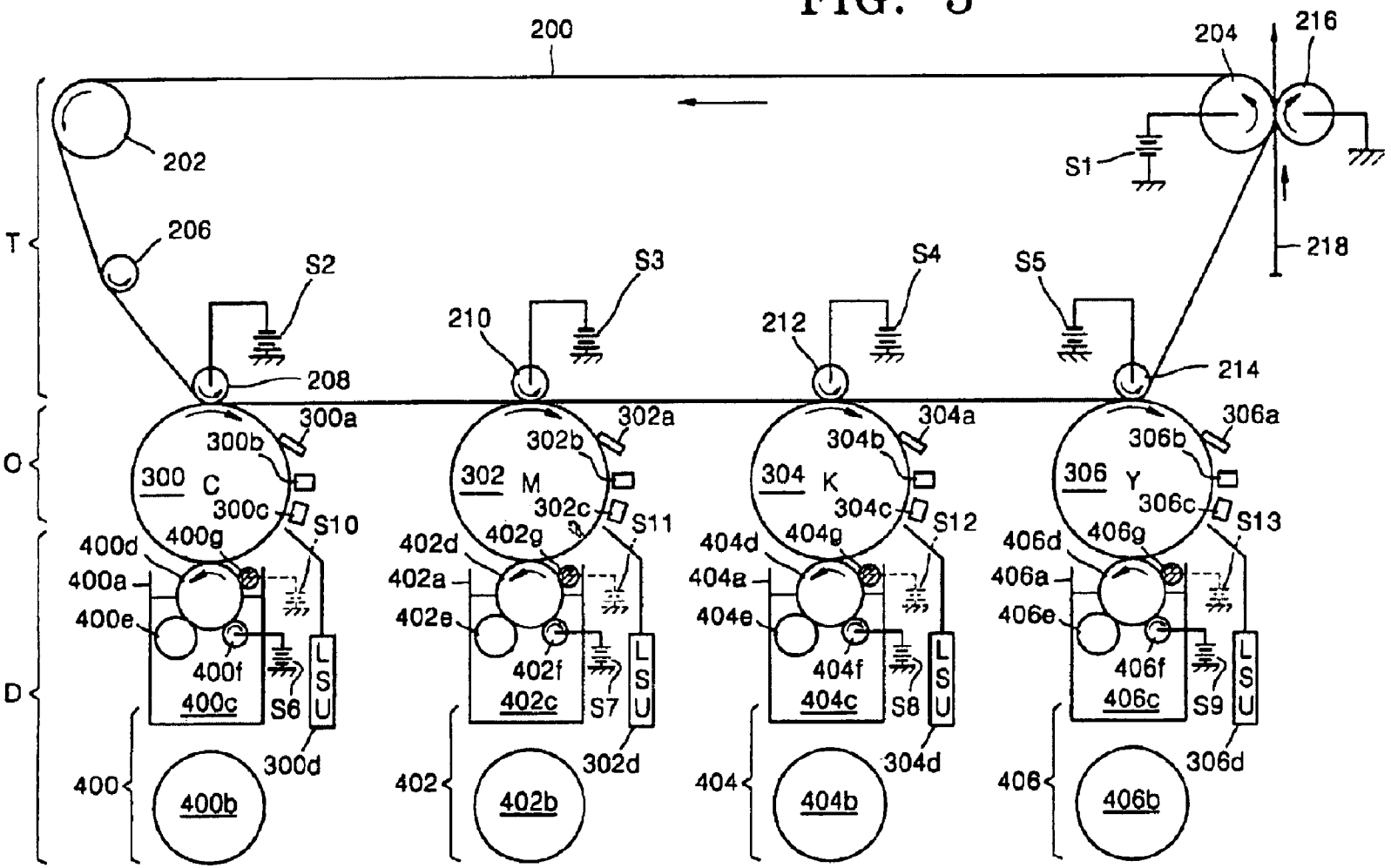
FIG. 5 is a sectional view showing the structure of a developer unit with a metering roller for a wet-type color image forming apparatus according to an embodiment of the present invention.

Referring to FIG. 5, a wet color image forming apparatus according to an embodiment of the invention includes a transfer unit T, a photoreceptor unit O, and a developer unit D. The transfer unit T includes a transfer belt 200 to which multiple toner images of different colors developed in the photoreceptor unit O are transferred to overlap one another to form a predetermined color image. The apparatus further includes a plurality of rollers 202, 204, 206, 208, 210, 212, and 214 displaced inside the transfer belt 200, and first through fifth power sources S1, S2, S3, S4, and S5 to supply power to the rollers 204, 208, 210, 212 and 214. The apparatus further includes a transfer-to-paper roller 216 to transfer the color image to a printing paper 218, which is grounded. The roller 204 is a backup roller, which is involved in transferring the color image to the printing paper 218 together with the transfer-to-paper roller 216, and is connected to the first power source S1. The first power source S1 charges the backup roller 204 to a same polarity as a polarity of the color image so as to apply a repulsive electrostatic force to the charged color image on the transfer belt 200. The rollers 208, 210, 212, and 214 are transfer rollers to transfer the developed images from all or some of the first through fourth photoreceptors 300, 302, 304, and 306 of the photoreceptor unit O while the developed images overlap one another. The rollers 202 and 206 support the transfer belt 200 together with the first through fourth transfer rollers 208, 210, 212, and 214 in a predetermined tensioned state. The roller 202 rotates the transfer belt 200 as a driver roller at an appropriate speed to transfer images.

Electrostatic latent images are formed in a region of photoreceptors 300, 302, 304, and 306. The images corresponding to original images of cyan (C), magenta (M), yellow (Y), and black (K) are formed in a predetermined region, respectively. First through fourth cleaning blades 300*a*, 302*a*, 304*a*, and 306*a* are disposed on the respective first through fourth photoreceptors 300, 302, 304, and 306 so as to remove the unnecessary ink remaining on the surfaces of the first through fourth photoreceptors 300, 302, 304, and 306 after the images have been transferred to the transfer belt 200. The first through fourth cleaning blades 300*a*, 302*a*, 304*a*, and 306*a* may have a same shape, or, alternately, may have different shapes. The photoreceptor unit O further includes first through fourth dischargers 300*b*, 302*b*, 304*b*, and 306*b* to neutralize the surface charge of the respective first through fourth photoreceptors 300, 302, 304, and 306 after the ink residue has been removed. The photoreceptor unit O further includes first through fourth chargers 300*c*, 302*c*, 304*c*, and 306*c* to charge, for example, positively, the neutralized surface of the respective first through fourth photoreceptors 300, 302, 304, and 306.

The first through fourth dischargers 300*b*, 302*b*, 304*b*, and 306*b* may have a same configuration. Alternately, the first through fourth dischargers 300*b*, 302*b*, 304*b*, and 306*b* can have different configurations as long as they can provide the discharging function. The same principle can be applied to the first through fourth chargers 300*c*, 302*c*, 304*c*, and 306*c*. First through fourth laser scanning units (LSUs) 300*d*, 302*d*, 304*d*, and 306*d* form the electrostatic images corresponding to the original images of C, M, Y, and K by scanning a predetermined charge region of the respective first through fourth photoreceptors 300, 302, 304, and 306. The LSUs 300*d*, 302*d*, 304*d* and 306*d* are disposed between the developer unit D and the respective first through fourth chargers 300*c*, 302*c*, 304*c*, and 306*c*.

The developer unit D includes first through fourth developers 400, 402, 404, and 406, which respectively correspond to the first through fourth photoreceptors 300, 302, 304, and 306, and develop the respective electrostatic latent images. The first through fourth developers 400, 402, 404, and 406 respectively include first through fourth developer baths 400*a*, 402*a*, 404*a*, and 406*a* and first through fourth developer cartridges 400*b*, 402*b*, 404*b*, and 406*b*. The first through fourth developer cartridges 400*b*, 402*b*, 404*b*, and 406*b* supply at least 2%, for example, 2–40% of a high-concentration developing agent 400*c*, 402*c*, 404*c* and 406*c*. The developing agent may be, for example, ink of C, M, Y, and K, to the respective first through fourth developer baths 400*a*, 402*a*, 404*a*, and 406*a*. The first through fourth developer baths 400*a*, 402*a*, 404*a*, and 406*a* are filled to a predetermined height with the respective first through fourth developing agents 400*c*, 402*c*, 404*c*, and 406*c*.

The first through fourth developers 400, 402, 404, and 406 include respective first through fourth developing rollers 400*d*, 402*d*, 404*d*, and 406*d* that are partially immersed in and respectively apply the first through fourth developing agents 400*c*, 402*c*, 404*c*, and 406*c* to the respective first through fourth photoreceptors 300, 302, 304, and 306. The developing rollers 400*d*, 402*d*, 404*d*, and 406*d* rotate in contact with the respective first through fourth photoreceptors 300, 302, 304, and 306. First through fourth cleaning rollers 400*e*, 402*e*, 404*e*, and 406*e* remove the toner layer remaining on the surface of the respective first through fourth developing rollers 400*d*, 402*d*, 404*d*, and 406*d* while rotating in contact with the respective first through fourth developing rollers 400*d*, 402*d*, 404*d*, and 406*d*. First through fourth depositing rollers 400*f*, 402*f*, 404*f*, and 406*f* are disposed in contact with the respective first through fourth developing rollers 400*d*, 402*d*, 404*d*, and 406*d* while being immersed in the respective first through fourth developing agents 400*c*, 402*c*, 404*c*, and 406*c* so as to deposit a sufficient amount of the first through fourth developing agents 400*c*, 402*c*, 404*c*, and 406*c* onto the respective first through fourth developing rollers 400*d*, 402*d*, 404*d*, and 406*d*.

The first through fourth depositing rollers 400*f*, 402*f*, 404*f*, and 406*f* deposit the respective first through fourth developing agents 400*c*, 402*c*, 404*c*, and 406*c* onto the respective first through fourth developing rollers 400*d*, 402*d*, 404*d*, and 406*d* using electrostatic force. To this end, the first through fourth depositing rollers 400*f*, 402*f*, 404*f*, and 406*f* are connected to sixth through ninth power sources S6, S7, S8, and S9, respectively. When the first through fourth developing agents 400*c*, 402*c*, 404*c*, and 406*c* are positively charged, a positive voltage is applied to the first through fourth depositing rollers 400*f*, 402*f*, 404*f*, and 406*f* from the respective sixth through ninth power sources S6, S7, S8, and S9.

Metering rollers 400*g*, 402*g*, 404*g*, and 406*g* are separated by a predetermined distance above the surface of the first through fourth developing agents 400*c*, 402*c*, 404*c*, and 406*c*. The first through fourth developing agents 400*c*, 402*c*, 404*c*, and 406*c* can be deposited onto the surface of the respective first through fourth developing rollers 400*d*, 402*d*, 404*d*, and 406*d* to an appropriate thickness and concentration to develop the electrostatic latent images formed on the first through fourth photoreceptors 300, 302, 304, and 306. The first through fourth metering rollers 400*g*, 402*g*, 404*g*, and 406*g* may rotate in a direction opposite to a direction in which the first through fourth developing rollers 400*d*, 402*d*, 404*d*, and 406*d* rotate. The metering rollers 400*g*, 402*g*, 404*g* and 406*g* may rotate due to the first through fourth developing rollers 400*d*, 402*d*, 404*d*, and 406*d*, or due to separate driving units.

In an alternative embodiment of the present invention, in order to adjust the thickness and concentration of the developing agents 400*c*, 402*c*, 404*c* and 406*c* deposited onto the first through fourth developing rollers 400*d*, 402*d*, 404*d*, and 406*d* to optimal levels, the tenth through thirteenth power sources S10, S11, S12, and S13 direct electrostatic force from the first through fourth metering rollers 400*g*, 402*g*, 404*g*, and 406*g* to the first through fourth developing rollers 400*d*, 402*d*, 404*d*, and 406*d*.

According to experiment, the developer unit having the metering rollers according to the embodiment of the present invention and a conventional developer unit having metering blades were both applied, for example, to a printer. As a result, a pull-down failure in a dot area occurred when the conventional developer unit was applied, whereas no pull-down failure in the dot area occurred when the developer unit having the metering rollers according to the embodiment of the present invention was applied.

While the present invention has been particularly described in the above with reference to embodiments thereof, the above embodiments of the present invention are for illustrative purposes and are not intended to limit the scope of the present invention. For example, it will be understood by those skilled in the art that the metering roller according to the present invention can be applied to any color image forming apparatus using a low-concentration liquid developing agent or using a solid developing agent. Alternatively, a power source can be connected to the conventional metering blade as in the present invention. Therefore, the spirit and scope of the invention should be defined by the appended claims rather than by the above-described embodiments.

As described above, a developer unit for a wet-type color image forming apparatus according to the embodiment of the present invention includes a cleaning roller, a depositing roller, and a metering roller. The metering roller adjusts the thickness and concentration of a developing agent layer deposited on the developing roller to suitable levels to develop an electrostatic latent image formed on a photoreceptor while rotating in a direction opposite to a direction in which the developing roller rotates. Since the metering roller according to the present invention rotates rather than being fixed, as in the conventional metering blade, back-plated toner particles or impurities deposited between the developing roller and the metering roller can be easily separated. This differs from the conventional developer units in which the back-plated toner particles or impurities are stuck in the space between the developing roller and the fixed metering blade.

The present metering roller continuously rotates in contact with the developing roller and attracts the back-plated toner particles or impurities so that no toner particle or impurity is stuck to the space between the developing roller and the metering roller. As a result, the developing agent layer deposited on the developing roller can be protected from being scratched by the back-plated toner particles or impurities, and thus no unwanted stripe pattern appears on the final image.

Although a preferred embodiment of the present invention has been shown and described, it will be appreciated by those skilled in the art that changes may be made in this embodiment without departing from the principles and spirit of the invention, the scope of which is defined in the claims and their equivalents.

What is claimed is:

1. A developer unit for a wet-type color image forming apparatus to develop an electrostatic latent image formed on a photoreceptor, comprising:

a developer bath filled with a liquid developing agent;

a developing roller to develop the electrostatic latent image to correspond to an original image by supplying the liquid developing agent while being partially immersed in the liquid developing agent;

a cleaning roller to clean a surface of the developing roller;

a depositing roller to deposit the liquid developing agent onto the cleaned surface of the developing roller;

a metering roller to rotate and thereby adjust a thickness and a concentration of the liquid developing agent deposited onto the surface of the developing roller to suitable levels; and a developer cartridge to supply the liquid developing agent into the developer bath.

2. The developer unit of claim 1, wherein the concentration of the liquid developing agent is initially 2% or more.

3. The developer unit of claim 1, wherein the metering roller is rotated by the developing roller.

4. The developer unit of claim 1, further comprising a drive source to rotate the metering roller.

5. The developer unit of claim 1, further comprising a power source to supply a power to the metering roller to generate an electrostatic force therein to adjust the thickness of the liquid developing agent.

6. An apparatus, comprising:

a photoreceptor having an electrostatic latent image thereon;

a developer unit to develop the electrostatic latent image formed on the photoreceptor, the developer unit comprising a developer bath filled with a liquid developing agent;

a developing roller to develop the electrostatic latent image to correspond to an original image by supplying the liquid developing agent while being partially immersed in the liquid developing agent;

a cleaning roller to clean a surface of the developing roller;

a depositing roller to deposit the liquid developing agent onto the cleaned surface of the developing roller;

a metering roller to rotate and thereby adjust a thickness and a concentration of the liquid developing agent deposited onto the surface of the developing roller to suitable levels; and a developer cartridge to supply the liquid developing agent into the developer bath.

7. The apparatus of claim 6, wherein the metering roller is separated from the developing roller to form a gap therebetween.

8. The apparatus of claim 6, wherein the developing roller rotates in a direction opposite to a direction of rotation of the metering roller.

9. The apparatus of claim 6, further comprising a drive unit to drive the metering roller.

10. The apparatus of claim 6, further comprising a power source to direct an electrostatic force from the metering roller to the developing roller to thereby adjust the thickness of the developer.

11. An apparatus, comprising:

a photoreceptor having an electrostatic latent image thereon;

a developing roller to develop the electrostatic latent image with a liquid developer comprised of particles, the developing roller being partially immersed in the developer; and a metering roller, spaced from the developing roller to form a gap therebetween, the metering roller generating an electrostatic force to attract the particles from the gap.

* * * * *